US012179985B2

(12) United States Patent
Sugizaki et al.

(10) Patent No.: US 12,179,985 B2
(45) Date of Patent: Dec. 31, 2024

(54) DECOMPRESSION ABSORPTION BOTTLE

(71) Applicant: YOSHINO KOGYOSHO CO., LTD., Tokyo (JP)

(72) Inventors: Takumi Sugizaki, Tokyo (JP); Hiroyuki Shima, Matsudo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 101 days.

(21) Appl. No.: 18/012,761

(22) PCT Filed: Jun. 25, 2021

(86) PCT No.: PCT/JP2021/024086

§ 371 (c)(1),
(2) Date: Dec. 23, 2022

(87) PCT Pub. No.: WO2021/261578

PCT Pub. Date: Dec. 30, 2021

(65) Prior Publication Data

US 2023/0249888 A1 Aug. 10, 2023

(30) Foreign Application Priority Data

Jun. 26, 2020 (JP) ..... 2020-110179
Apr. 8, 2021 (JP) ..... 2021-065836

(51) Int. Cl.
*B65D 79/00* (2006.01)
*B65D 1/02* (2006.01)

(52) U.S. Cl.
CPC ..... *B65D 79/0081* (2020.05); *B65D 1/0276* (2013.01); *B65D 2501/0036* (2013.01)

(58) Field of Classification Search
CPC .. B65D 79/00–0081; B65D 1/00–0276; B65D 2501/00–0036
See application file for complete search history.

(56) References Cited

U.S. PATENT DOCUMENTS 1,995,703 A * 3/1935 Clark ..... B65D 1/0207 118/DIG. 3
2,836,318 A * 5/1958 Adakonis ..... C08J 7/043 8/DIG. 10

(Continued)

FOREIGN PATENT DOCUMENTS

JP H08-133260 A 5/1996
JP 2010-275007 A 12/2010

(Continued)

OTHER PUBLICATIONS

Aug. 31, 2021 International Search Report issued in International Patent Application No. PCT/JP2021/024086.

*Primary Examiner* — Kareen K Thomas
(74) *Attorney, Agent, or Firm* — Oliff PLC

(57) ABSTRACT

A decompression absorption bottle is formed of a synthetic resin material and has a cylindrical shape with a bottom. A bottom wall part of a bottom part includes a ground contact part; an upright peripheral wall part; and an annular movable wall part, the movable wall part is disposed to be freely rotatable in a vertical direction, the movable wall part is provided with an annular recess, and the annular recess is configured that an inner corner part having a V-shape or a U-shape protruding inward in the radial direction of the bottle when viewed from below, and an outer corner part having a V-shape or U-shape protruding outward in the radial direction of the bottle are alternately continued to each other in the circumferential direction of the bottle.

11 Claims, 8 Drawing Sheets

(56) References Cited

U.S. PATENT DOCUMENTS

| | | | | | |
|---|---|---|---|---|---|
| 4,803,036 | A * | 2/1989 | Maruhashi | B29C 49/64 | 264/526 |
| 4,846,359 | A * | 7/1989 | Baird | B29C 49/22 | 215/12.2 |
| 4,977,004 | A * | 12/1990 | Bettle, III | B65D 1/0215 | 428/34.3 |
| 5,273,182 | A * | 12/1993 | Laybourne | A47G 23/03 | 248/346.11 |
| 5,738,921 | A * | 4/1998 | Andersen | B32B 5/14 | 428/36.1 |
| 5,814,383 | A * | 9/1998 | Fehn | B32B 27/08 | 220/660 |
| 6,666,001 | B2 * | 12/2003 | Mero | B65D 1/0223 | 215/381 |
| 9,394,072 | B2 | 7/2016 | Patcheak et al. | | |
| 2014/0034659 | A1 | 2/2014 | Nakayama | | |

FOREIGN PATENT DOCUMENTS

| | | | |
|---|---|---|---|
| JP | 2012-232772 | A | 11/2012 |
| JP | 2013-023278 | A | 2/2013 |
| JP | 2013-159380 | A | 8/2013 |

* cited by examiner

DECOMPRESSION ABSORPTION BOTTLE

TECHNICAL FIELD

The present invention relates to a decompression absorption bottle. Priority is claimed on Japanese Patent Application Nos. 2020-110179, filed Jun. 26, 2020, and 2021-065836 filed Apr. 8, 2021, the contents of which are incorporated herein by reference.

BACKGROUND ART

In the related art, as a decompression absorption bottle formed of a synthetic resin material in a bottomed cylindrical shape, for example, as shown in Patent Document 1 below, a configuration, in which a bottom wall part of a bottom part includes a ground contact part located at an outer peripheral edge portion, a upright peripheral wall part that is joined to the ground contact part from the inside in a radial direction of the bottle and extends upward, and an annular movable wall part which extends inward in the radial direction of the bottle from an upper end portion of the upright peripheral wall, and the movable wall part absorbs the decompression in the bottle by turning upward around a connecting portion with the upright peripheral wall part, is known.

CITATION LIST

Patent Document

[Patent Document 1]
Japanese Unexamined Patent Application, First Publication No. 2013-23278

SUMMARY OF INVENTION

Technical Problem

However, there was room for improvement in suppressing deformation of a body part by preferentially deforming the bottom part, when decompressing the inside of the decompression absorption bottle.

Therefore, an object of the present invention is to provide a decompression absorption bottle that is capable of suppressing deformation of the body part, by preferentially deforming the bottom part, when decompressing the inside of the decompression absorption bottle.

Solution to Problem

The present invention has adopted the following means to solve the aforementioned problems. That is, according to first aspect of the present invention, there is provided a decompression absorption bottle which is formed of a synthetic resin material and has a cylindrical shape with a bottom, in which a bottom wall part of a bottom part includes a ground contact part located on an outer peripheral edge portion; an upright peripheral wall part which is continued to the ground contact part from the inside in a radial direction of the bottle and extends upward; and an annular movable wall part which extends inward in the radial direction of the battle from an upper end portion of the upright peripheral wall part, in which the movable wall part is disposed to be freely rotatable in a vertical direction around a connecting portion with the upright peripheral wall part, the movable wall part is provided with annular recesses which are recessed upward and extend in a circumferential direction of the bottle, and the annular recesses have a configuration in which inner corner parts having a V-shape or a U-shape protruding inward in the radial direction of the bottle when viewed from below, and outer corner parts having a V-shape or U-shape protruding outward in the radial direction of the bottle are alternately continued to each other in the circumferential direction of the bottle.

In the first aspect of the present invention, the movable wall part is provided with an annular recess that is recessed upward and extends in the circumferential direction of the bottle, and the annular recess is configured by alternate joining of the inner corner part and the outer corner part in the circumferential direction of the bottle. As a result, when decompressing the inside of the decompression absorption bottle (hereinafter referred to as a decompression time), the movable wall part not only turns upward around the connecting portion with the upright peripheral wall part, but also each portion in the movable wall part in which the inner end portions of the plurality of inner corner parts in the radial direction of the bottle are located serves as a starting point, which makes it possible to easily deform the movable wall part upward, and at the time of decompression, the bottom part can be preferentially deformed to suppress deformation of the body part.

According to a second aspect of the present invention, in the decompression absorption bottle of the first aspect, the movable wall part may be formed in a curved surface shape which protrudes downward, and an inner end portion of the inner corner part in the radial direction of the bottle may be provided at a lowermost part located at a lowermost position of the movable wall part.

In this case, the movable wall part is formed in a curved surface shape that protrudes downward. As a result, it is possible to secure a pressure-receiving area of the movable wall part, and to secure a large deformation allowance toward the upper side of the movable wall part at the time of decompression.

In the movable wall part, the lowermost part, which is located at the lowest side and is unlikely to be deformed upward at the time of decompression, is provided with an inner end portion in the radial direction of the bottle at the inner corner part, which serves as a starting point of deformation at the time of decompression. As a result, at the time of decompression, the movable wall part can be easily deformed upward smoothly, and the deformation of the body part can be reliably suppressed.

According to a third aspect of the present invention, in the decompression absorption bottle of the first aspect or the second aspect, radial recesses which are recessed upward and extend in the radial direction of the battle may be separately provided at portions in the movable wall part, the portions which are located on both sides that sandwich an inner end portion in the radial direction of the bottle at the inner corner part in the circumferential direction of the bottle.

In this case, radial recesses that are recessed upward and extend in the radial direction of the bottle are separately provided at portions of the movable wall part located on both sides that sandwich the inner end portion in the radial direction of the bottle at the inner corner part in the circumferential direction of the bottle. As a result, at the time of decompression, in the movable wall part, a plurality of panel surface parts surrounded by the inner corner part and the two radial recesses that sandwich the inner end portion in the radial direction of the bottle at the inner corner part in the circumferential direction of the bottle are individually deformed upward, starting from a portion in which the inner end portion in the radial direction of the bottle at the inner corner part is located. As a result, at the time of decompression, the movable wall part can be easily and smoothly deformed upward.

According to a fourth aspect of the present invention, in the decompression absorption bottle of the third aspect, the radial recesses may be located on a straight line which passes through an outer end portion in the radial direction of the bottle at the outer corner part and a bottle axis when viewed from below.

In this case, the radial recess is located on a straight line passing through the outer end portion in the radial direction of the bottle at the outer corner part and the bottle axis when viewed from below. As a result, a large panel surface part as mentioned above can be secured, and the movable wall part can be reliably and easily deformed upward smoothly at the time of decompression.

According to a fifth aspect of the present invention, in the decompression absorption bottle according to any one of the first to fourth aspects, the inner end portion in the radial direction of the bottle at the inner corner part may be provided at a portion of the movable wall part, the portion which is located further outward in the radial direction of the bottle than a central position in the radial direction of the bottle.

In this case, the inner end portion in the radial direction of the bottle at the inner corner part is provided in at a portion of the movable wall part located on the outer side in the radial direction of the bottle than the central position in the radial direction of the bottle. As a result, it is possible to widely secure a portion of the movable wall part surrounded by the annular recess, and it is possible to reliably and easily deform the movable wall part upward smoothly at the time of decompression.

In the movable wall part, in a case where radial recesses are separately provided at the portion of the movable wall part located on both sides that sandwich the inner end portion in the radial direction of the bottle at the inner corner part in the circumferential direction of the bottle, when the inner end portion in the radial direction of the bottle at the inner corner part is provided at the portion of the movable wall part located on the outer side in the radial direction of the bottle than the central position in the radial direction of the bottle, the above-mentioned panel surface part can be widely secured. As a result, it is possible to reliably and easily deform the movable wall part upward smoothly at the time of decompression.

According to a sixth aspect of the present invention, in the decompression absorption bottle of the first aspect, the movable wall part may be provided with a first radial recess which is recessed upward and extends from the inner end portion in the radial direction of the bottle at the inner corner part in the radial direction of the bottle.

In this case, the movable wall part is provided with a first radial recess that is recessed upward and extends from the inner end portion in the radial direction of the bottle at the inner corner part in the radial direction of the bottle. As a result, at the time of decompression, not only the inner end portion in the radial direction of the bottle at the inner corner part but also the portion of the movable wall part that is continued to the inner end portion in the radial direction of the bottle can be easily deformed upward.

Accordingly, it is possible to preferentially deform the bottom part at the time of depressurization to suppress the deformation of the body part.

According to a seventh aspect of the present invention, in the decompression absorption bottle of the sixth aspect, the first radial recess may straddle the inner end portion in the radial direction of the bottle at the inner corner part in the radial direction of the bottle when viewed from below.

In this case, the first radial recess straddles the inner end portion in the radial direction of the bottle at the inner corner part in the radial direction of the bottle when viewed from below. As a result, at the time of decompression, the portion of the movable wall part that is continued to the inner end portion in the radial direction of the bottle at the inner corner part in the radial direction of the bottle can be easily deformed upward over a wide range.

According to an eighth aspect of the present invention, in the decompression absorption bottle of the sixth aspect or the seventh aspect, the movable wall part may be formed in a curved surface shape that protrudes downward, and the inner corner part may straddle the lowermost part located at the lowermost position of the movable wall part in the radial direction of the bottle.

In this case, the movable wall part is formed in a curved surface shape that protrudes downward. As a result, it is possible to secure the pressure-receiving area of the movable wall part, and to secure a large deformation allowance toward the upper side of the movable wall part at the time of decompression.

The inner corner part having a portion, which serves a starting point of deformation at the time of decompression, straddles the lowermost part of the movable wall part, which is located at the lowest position and is unlikely to be deformed upward at the time of decompression, in the radial direction of the bottle. As a result, at the time of decompression, the movable wall part can be easily deformed upward smoothly, and the deformation of the body part can be reliably suppressed.

According to a ninth aspect of the present invention, in the decompression absorption bottle according to any one of the sixth to eighth aspects, the inner end portion in the radial direction of the bottle at the inner corner part may be provided at a portion of the movable wall part, the portion which is located on the outer side in the radial direction of the bottle than the central position in the radial direction of the bottle.

In this case, the inner end portion in the radial direction of the bottle at the inner corner part is provided at a portion of the movable wall part located on the outer side in the radial direction of the bottle than the central position in the radial direction of the bottle. Accordingly, it is possible to widely secure the portion of the movable wall part surrounded by the annular recess, and to reliably and easily deform the movable wall part upward smoothly at the time of decompression.

According to a tenth aspect of the present invention, in the decompression absorption bottle of any one of the sixth to ninth aspects, second radial recesses which are recessed upward and extend in the radial direction of the bottle may be separately provided at portions in the movable wall part, the portions which are located on both sides that sandwich an inner end portion n the radial direction of the bottle at the inner corner part in the circumferential direction of the bottle.

In this case, second radial recesses that are recessed upward and extend in the radial direction of the bottle are separately provided at portions of the movable wall part located on both sides that sandwich the inner end portion in the radial direction of the bottle at the inner corner part in the circumferential direction of the bottle. As a result, at the time of decompression, in the movable wall part, the plurality of panel surface parts surrounded by the inner corner part and the two second radial recesses that sandwich the inner end portion in the radial direction of the bottle at the inner corner part in the circumferential direction of the bottle are individually deformed upward, starting from the portion in which the inner end portion in the radial direction of the bottle at the inner corner part is located. As a result, at the time of decompression, the movable wall part can be easily deformed upward smoothly.

When the inner end portion in the radial direction of the bottle at the inner corner part is provided at a portion of the movable wall part located on the outer side in the radial direction of the bottle than the central position in the radial direction of the bottle, it is possible to widely secure the above-mentioned panel surface part. Accordingly, it is possible to reliably and easily deform the movable wall part upward smoothly at the time of decompression.

According to an eleventh aspect of the present invention, in the decompression absorption bottle of the tenth aspect, the second radial recesses may be located on a straight line which passes through an outer end portion in the radial direction of the bottle at the outer corner part and a bottle axis when viewed from below.

In this case, the second radial recesses are located on a straight line passing through the outer end portion in the radial direction of the bottle at the outer corner part and the bottle axis when viewed from below. As a result, it is possible to widely secure the above-mentioned panel surface part, and to reliably and easily deform the movable wall part upward smoothly at the time of decompression.

Advantageous Effects of Invention

According to the present invention, it is possible to suppress deformation of the body part, by preferentially deforming the bottom part when decompressing the inside of the decompression absorption bottle.

DESCRIPTION OF EMBODIMENTS

First Embodiment

Figure 1:
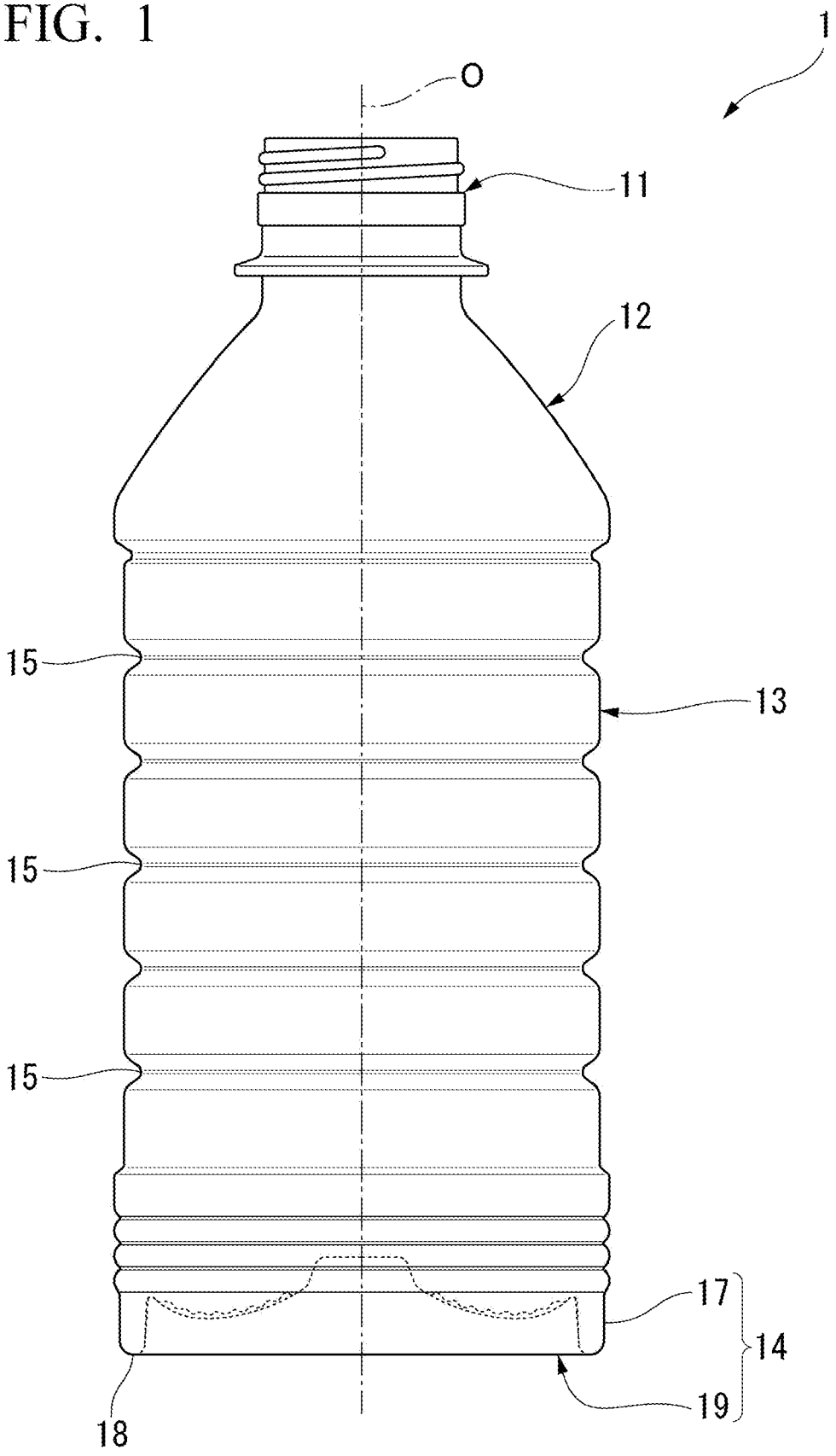
FIG. 1 is a side view of a decompression absorption bottle shown as a first embodiment according to the present invention.

Hereinafter, a decompression absorption bottle according to the first embodiment of the present invention will be described with reference to the drawings. As shown in FIG. 1, a decompression absorption bottle 1 according to the present embodiment includes a mouth part 11, a shoulder part 12, a body part 13 and a bottom part 14, and the decompression absorption bottle 1 has a schematic configuration in which the mouth part 11, the shoulder part 12, the body part 13 and the bottom part 14 are continuously provided in this order with each central axis positioned on a common shaft.

Hereinafter, the common axis is referred to as a bottle axis O, the mouth part 11 side along the bottle axis O is referred to as an upper side, the bottom part 14 side is referred to as a lower side, a direction along the bottle axis O is referred to as a vertical direction, a direction that intersects the bottle axis O when viewed from the vertical direction is referred to as a radial direction of the bottle, and a direction of revolving around the bottle axis O is referred to as a circumferential direction of the bottle.

The decompression absorption bottle 1 is formed by blow molding a preform formed into a cylinder with a bottom by injection molding, and is integrally formed of a synthetic resin material. A cap (not shown) is attached to the mouth part 11. The mouth part 11, the shoulder part 12, the body part 13, and the bottom part 14 each have a circular shape when viewed in a cross section orthogonal to the bottle axis O.

A plurality of peripheral grooves 15 extending continuously over the entire circumference are formed in the body part 13 at intervals in the vertical direction.

The bottom part 14 is formed in a cup shape that includes a cylindrical heel part 17 in which an upper end opening portion is connected to a lower end opening portion of the body part 13, and a bottom wall part 19 which closes the lower end opening portion of the heel part 17 and has an outer peripheral edge portion as the ground contact part 18. That is, the bottom part 14 includes the heel part 17 and the bottom wall part 19, and the heel part 17 and the bottom wall part 19 form a cup shape.

Figure 2:
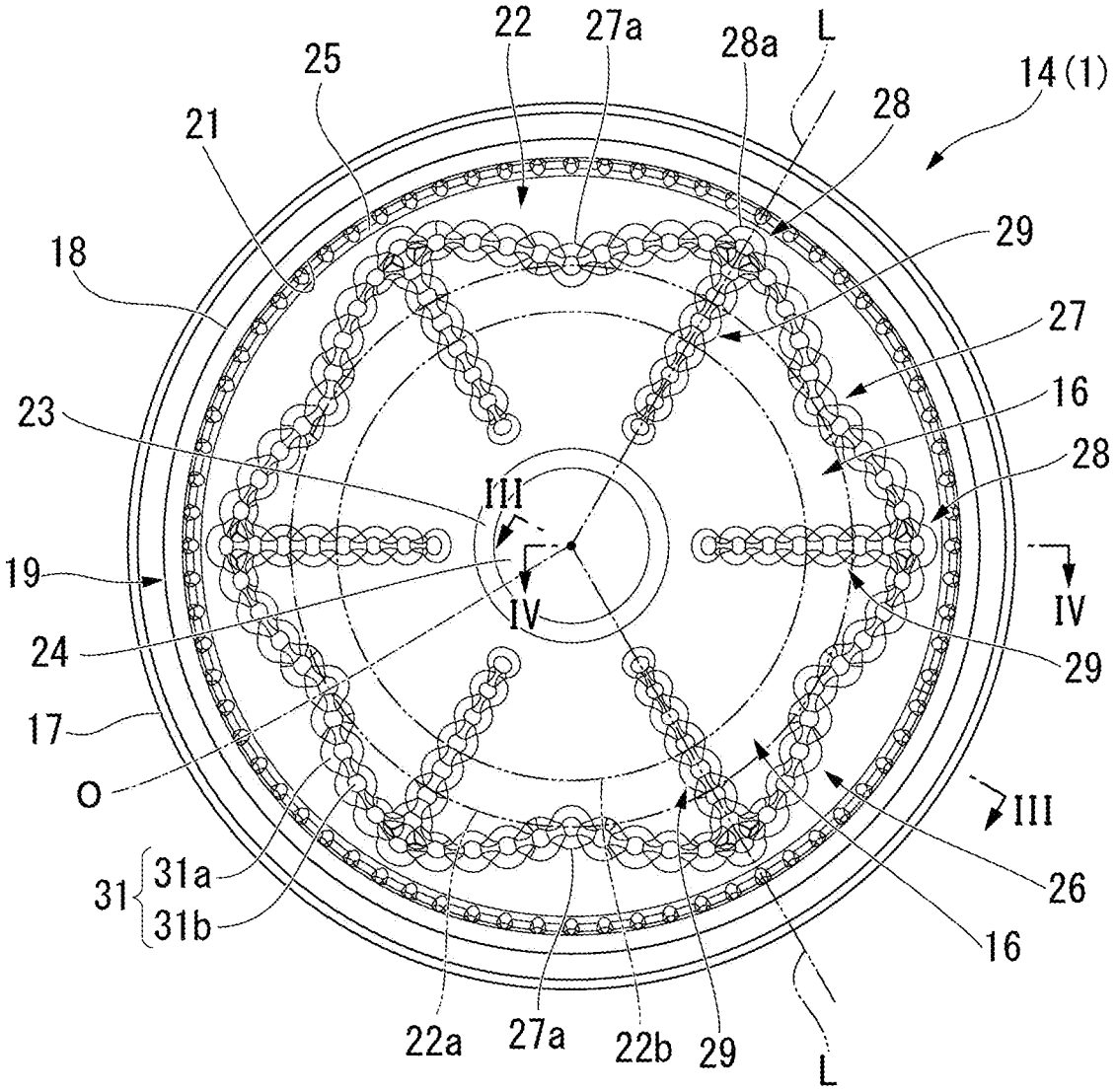
FIG. 2 is a bottom view of the decompression absorption bottle shown in FIG. 1.
Figure 3:
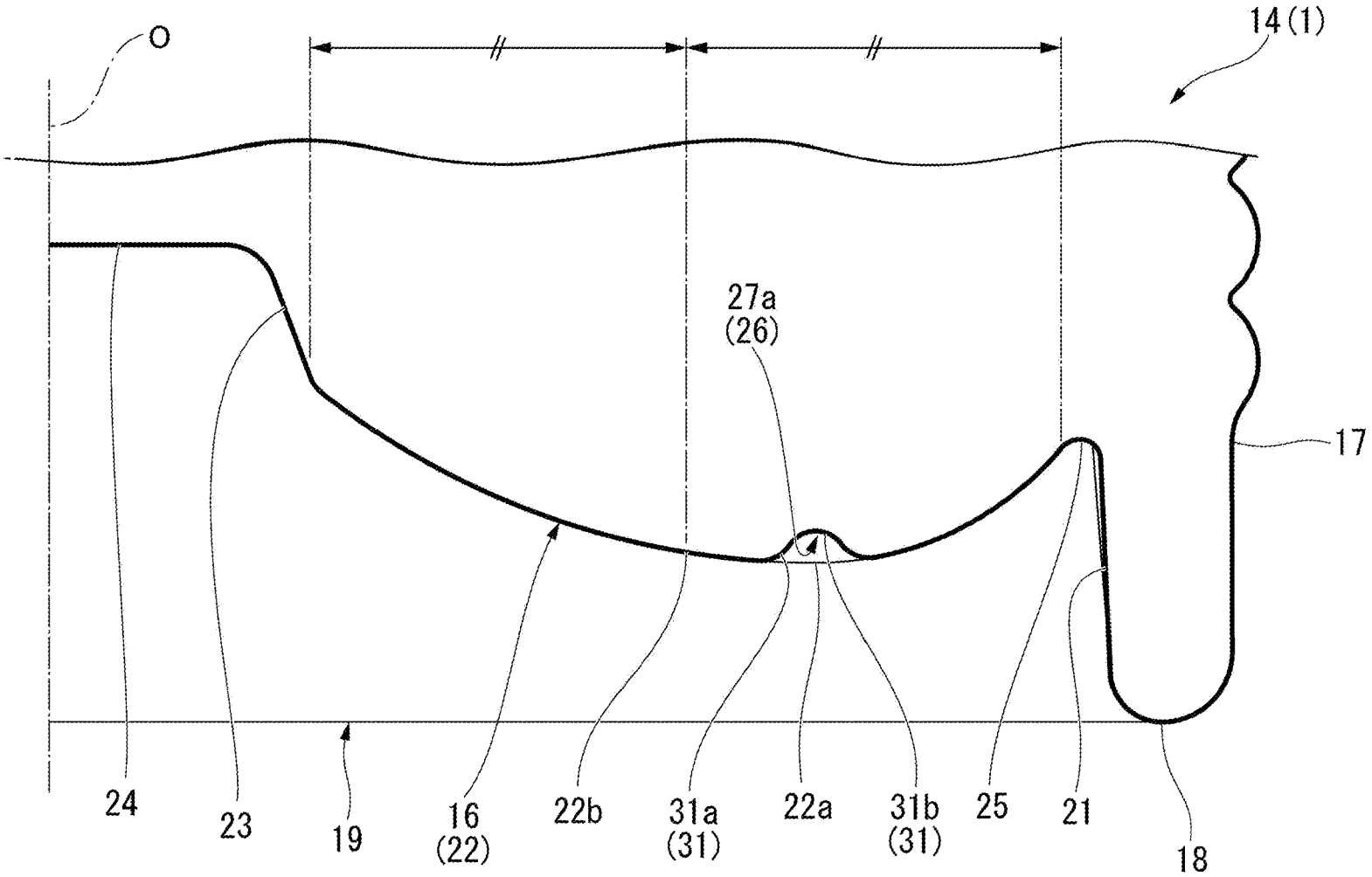
FIG. 3 is a cross-sectional view taken along a line III-III of FIG. 2.
Figure 4:
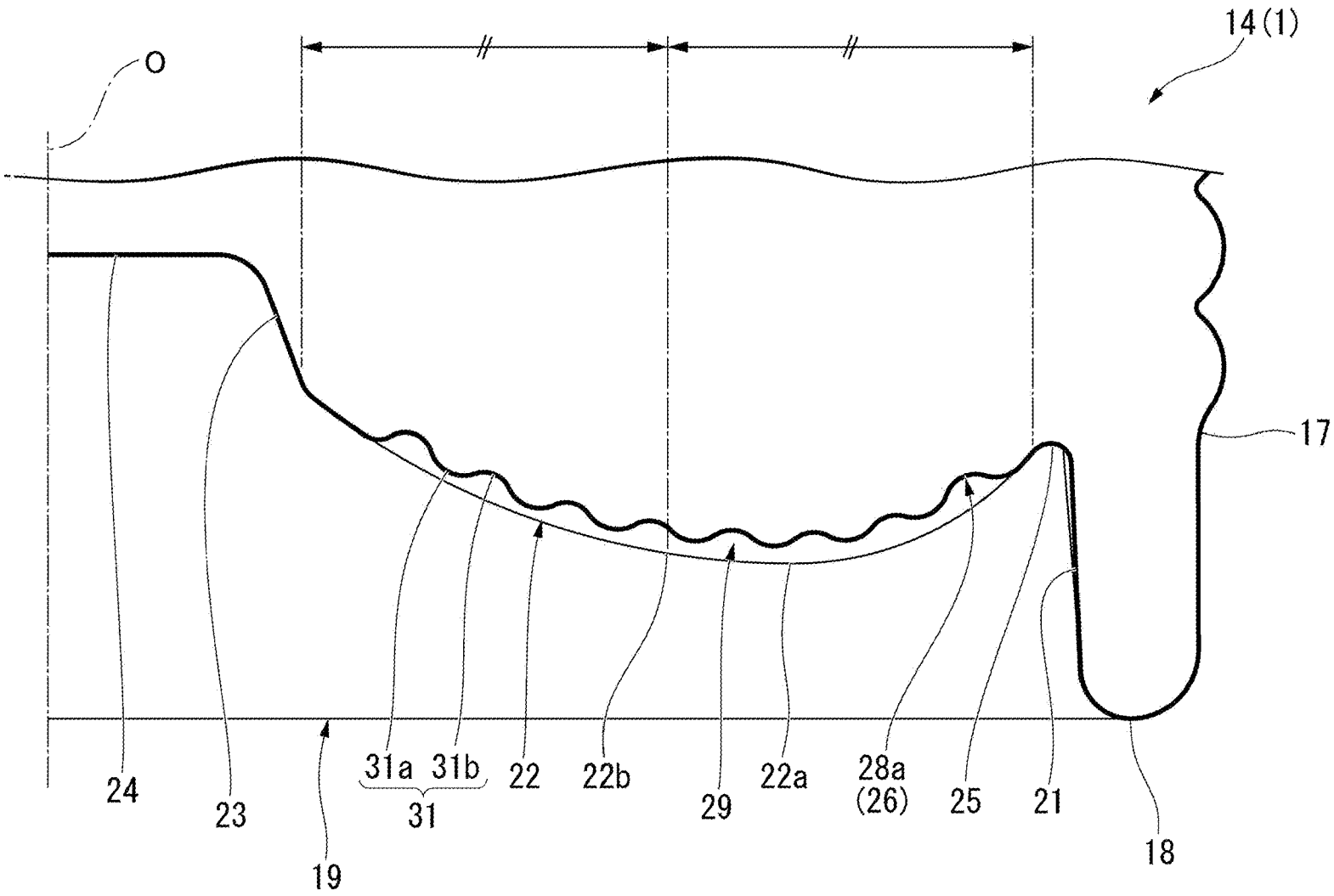
FIG. 4 is a cross-sectional view taken along a line IV-IV of FIG. 2.

As shown in FIGS. 2 to 4, the bottom wall part 19 includes an upright peripheral wall part 21 that is continued to the ground contact part 18 from the inside in the radial direction of the bottle and extends upward, an annular movable wall part 22 that extends inward in the radial direction of the bottle from the upper end portion of the upright peripheral wall part 21, and a central wall part 23 that is connected to an inner end portion of the movable wall part 22 in the radial direction of the bottle.

The upright peripheral wall part 21 extends almost straight along the vertical direction. The upright peripheral wall part 21 may extend in parallel with the bottle axis O, or may be inclined by 5° or less, preferably 3° or less in the vertical direction to extend inward in the radial direction of the bottle from the lower side to the upper side in consideration of release properties of the mold. In the shown example, an inclined angle of the upright peripheral wall part 21 is, for example, about 2.5°.

The central wall part 23 extends upward from the inner end portion of the movable wall part 22 in the radial direction of the bottle. The central wall part 23 is disposed coaxially with the bottle axis O, and is formed in a cylindrical shape whose diameter increases from the upper side to the lower side. A disk-shaped top wall 24 disposed coaxially with the bottle axis O is connected to the upper end portion of the central wall part 23, and the central wall part 23 and the top wall 24 as a whole form a topped cylindrical shape. The central wall part 23 has a circular shape in a cross-sectional view. The central wall part 23 may have, for example, a square shape or the like in a cross-sectional view.

The movable wall part 22 is formed in an annular shape and is disposed coaxially with the bottle axis O. In the movable wall part 22, an outer end portion in the radial direction of the bottle is connected to an upper end portion of the upright peripheral wall part 21, and an inner end portion in the radial direction of the bottle is connected to an outer end portion of the central wall part 23 in the radial direction of the bottle. The outer end portion of the movable wall part 22 in the radial direction of the bottle and the upper end portion of the upright peripheral wall part 21 are connected to each other via a curved surface part 25 that is recessed upward. The movable Null part 22 is freely rotatable around the curved surface portion (a connecting portion with the upright peripheral wall part 21) 25 to move the central wall part 23 in the vertical direction.

The movable wall part 22 is formed in a curved surface shape that protrudes downward. The lowermost part 22*a* located at the lowermost part of the movable wall part 22 is disposed at a portion of the movable wall part 22 located outside in the radial direction of the bottle of a central position 22*b* in the radial direction of the bottle. The movable wall part 22 extends upward as it goes away from the lowermost part 22*a* in the radial direction of the bottle.

The lowermost part 22*a* may be disposed at the central position 22*b* of the movable wall part 22 in the radial direction of the bottle, or may be disposed inside in the radial direction of the bottle of the central position 22*b* in the radial direction of the bottle in the movable wall part 22.

The lowermost part 22*a* is located below the curved surface part 25. In the vertical cross-sectional view along the vertical direction, the radius of curvature of the portion of the movable wall part 22 at which the lowermost part 22*a* is located is larger than the radius of curvature of the curved surface part 25. In the vertical cross-sectional view, the radius of curvature of the portion of the movable wall part 22 located inside the lowermost part 22*a* in the radial direction of the bottle is larger than the radius of curvature of the portion located outside the lowermost part 22*a* in the radial direction of the bottle.

The decompression absorption bottle 1 configured as described above is filled with the contents of a high temperature (for example, about 40° C. to 95° C.), and at this time, the movable wall part 22 is displaced and deformed downward. By sealing in this state, the moveable wall part 22 turns upward around the curved surface part 25 while being deformed upward when decompressing the inside of the decompression absorption bottle 1 with the subsequent cooling, and the decompression is absorbed.

Further, in the present embodiment, the movable wall part 22 is provided with an annular recess 26 that is recessed upward and extends in the circumferential direction of the bottle. The annular recess 26 has a configuration in which an inner corner part 27 having a V-shape or a U-shape that is convex toward the inside in the radial direction of the bottle and an outer corner part 28 having a V-shape or a U-shape protruding outward in the radial direction of the bottle are alternately continued to each other in the circumferential direction of the bottle, when viewed from below.

When viewed from below, respective angles formed by the inner corner part 27 and the outer corner part 28 are the same as each other. When viewed from below, the respective angles formed by the inner corner part 27 and the outer corner part 28 may be different from each other. The number of each of the inner corner part 27 and the outer corner part 28 is the same, for example, 3 to 12 are preferable, and the number is 6 in the shown example.

The outer end portion (hereinafter referred to as a peak part) 28*a* of the outer corner part 28 in the radial direction of the bottle is provided at the outer end portion of the movable wall part 22 in the radial direction of the bottle.

The inner end portion (hereinafter referred to as a valley part) 27*a* of the inner corner part 27 in the radial direction of the bottle is provided in a portion of the movable wall part 22 located on the outer side in the radial direction of the bottle than the central position 22*b* in the radial direction of the bottle. The valley part 27*a* is provided at the lowermost part 22*a* of the movable wall part 22.

The valley part 27*a* may be provided at the central position 22*b* of the movable wall part 22 in the radial direction of the bottle, or may be provided in a portion of the movable wall part 22 located on the inner side in the radial direction of the bottle than the central position 22*b* in the radial direction of the bottle, or may be provided in a portion of the movable wall part 22 other than the lowermost part 22*a*.

In the movable wall part 22, radial recesses 29 that are recessed upward and extend in the radial direction of the bottle are separately provided at portions located on both sides of the valley part 27*a* in the circumferential direction of the bottle. A plurality (for example, three to eight) of radial recesses 29 are provided at equal intervals in the circumferential direction of the bottle.

In the movable wall part 22, a portion located inside the annular recess 26 in the radial direction of the bottle has a configuration in which a plurality of panel surface parts 16 surrounded by the inner corner part 27 and two radial recesses 29 sandwiching the valley part 27*a* in the circumferential direction of the bottle are connected in the circumferential direction of the bottle via the radial recess 29.

The plurality of valley parts 27*a* may be located between the radial recesses 29 that are adjacent to each other in the circumferential direction of the bottle.

The widths of each of the radial recess 29 and the annular recess 26 are the same as each other. The radial recess 29 is located on a straight line L passing through the peak part 28*a* and the bottle axis O when viewed from below.

The widths of each of the radial recess 29 and the annular recess 26 may be different from each other. The radial recess 29 may be located on a straight line passing through a portion located between the peak part 28*a* and the valley part 27*a*, and the bottle axis O when viewed from below.

An outer end portion of the radial recess 29 in the radial direction of the bottle is connected to the annular recess 26. An inner end portion of the radial recess 29 in the radial direction of the bottle is located outside the outer end portion in the radial direction of the bottle of the central wall part 23 in the radial direction of the bottle.

The outer end portion of the radial recess 29 in the radial direction of the bottle may be located inside the annular recess 26 in the radial direction of the bottle, and the inner end portion of the radial recess 29 in the radial direction of the bottle may be connected to the outer end portion of the central wall part 23 in the radial direction of the bottle.

The annular recess 26 and the radial recess 29 are each configured by connection of a plurality of dimples 31 formed in a curved surface that are recessed upward. The annular recess 26 is configured by connection of the plurality of dimples 31 in the circumferential direction of the bottle, and the radial recess 29 is configured by connection of the plurality of dimples 31 in the radial direction of the bottle. The dimples 31 of each of the annular recess 26 and the radial recess 29 have the same shape and the same size.

The dimples 31 of each of the annular recess 26 and the radial recess 29 may be formed in different shapes and different sizes.

In the shown example, each dimple 31 is constituted by a connecting recess 31*a* and a main body recess 31*b* formed on the bottom surface of the connecting recess 31*a*. An inner diameter of the main body recess 31*b* is smaller than the inner diameter of the connecting recess 31*a*. In each of the annular recess 26 and the radial recess 29, the main body recesses 31*b* adjacent to each other are provided at intervals, and the connecting recesses 31*a* adjacent to each other are provided in a row.

Each dimple 31 may include only one of the main body recess 31*b* and the connecting recess 31*a*, and the dimples 31 adjacent to each other may be provided at intervals. The annular recess 26 and the radial recess 29 may be formed by a groove extending linearly continuously or a groove extending intermittently linearly, instead of the plurality of dimples 31.

As described above, according to the decompression absorption bottle 1 according to the present embodiment, the movable wall part 22 is provided with an annular recess 26 that is recessed upward and extends in the circumferential direction of the bottle, and the annular recess 26 is configured by alternate joining of the inner corner part 27 and the outer corner part 28 in the circumferential direction of the bottle. As a result, when decompressing the inside of the decompression absorption bottle 1 (hereinafter referred to as a decompression time), the movable wall part 22 not only turns upward around the curved surface part 25, but also each portion in the movable wall part 22 in which the plurality of valley parts 27*a* are located serves as a starting point, which makes it possible to easily deform the movable wall part 22 upward, and at the time of decompression, the bottom part 14 can be preferentially deformed to suppress deformation of the body part 13.

The movable wall part 22 is formed in a curved surface shape that protrudes downward. As a result, it is possible to secure a pressure-receiving area of the movable wall part 22, and to greatly secure a deformation allowance toward the upper side of the movable wall part 22 at the time of decompression.

In the movable wall part 22, the lowermost part 22*a*, which is located at the lowest side and is unlikely to be deformed upward at the time of decompression, is provided with a valley part 27*a*, which serves as a starting point of deformation at the time of decompression. As a result, at the time of decompression, the movable wall part 22 can be easily deformed upward smoothly, and the deformation of the body part 13 can be reliably suppressed.

In the movable wall part 22, radial recesses 29 that are recessed upward and extend in the radial direction of the bottle are separately provided at portions located on both sides of the valley part 27*a* in the circumferential direction of the bottle. As a result, at the time of decompression, in the movable wall parts 22, the plurality of panel surface parts 16 surrounded by the inner corner part 27 and the two radial recesses 29 that sandwich the valley part 27*a* in the circumferential direction of the bottle are individually deformed upward starting from the portion in which the valley part 27*a* is located. As a result, at the time of decompression, the movable wall part 22 can be easily deformed upward.

The radial recess 29 is located on a straight line L passing through the peak part 28*a* and the bottle axis O when viewed from below. As a result, the above-mentioned panel surface part 16 can be secured widely, and the movable wall part 22 can be reliably and easily deformed upward smoothly at the time of decompression.

The valley part 27*a* is provided at a portion of the movable wall part 22 located outside in the radial direction of the bottle of the central position 22*b* in the radial direction of the bottle. This makes it possible to widely secure a portion of the movable wall part 22 surrounded by the annular recess 26 and the above-mentioned panel surface part 16. As a result, it is possible to reliably and smoothly deform the movable wall part 22 upward at the time of decompression.

The technical scope of the present invention is not limited to the above-described embodiment, and various modifications can be made without departing from the spirit of the present invention.

For example, the central wall part 23 is not limited to that of the above embodiment. The central wall part 23 may be appropriately modified such that it extends straight along the vertical direction or is formed in a flat plate shape.

As the bottom wall part 19, a configuration having no top wall 24 and having, for example, a central wall part 23 formed in a conical shape may be adopted.

As the annular recess 26, a configuration having a single inner corner part 27 may be adopted.

A configuration having no radial recess 29 may be adopted.

The synthetic resin material that forms the decompression absorption bottle 1 may be appropriately changed to, for example, polyethylene terephthalate, polyethylene naphthalate, amorphous polyester, a blend material thereof, or the like.

The decompression absorption bottle 1 is not limited to a single-layer structure, but may be a laminated structure having an intermediate layer. Examples of the intermediate layer include a layer made of a resin material having a gas barrier property, a layer made of a recycled material, a layer made of a resin material having an oxygen absorption property, and the like.

In the above embodiment, although the shape when viewed in a cross section orthogonal to the bottle axis O of each of the mouth part 11, the shoulder part 12, the body part 13 and the bottom part 14 is a circular shape, the present invention is not limited thereto. The shape when viewed in a cross section may be appropriately changed, for example, to have a square shape.

In addition, it is possible to replace the components in the embodiment with well-known components as appropriate without departing from the spirit of the present invention, and the embodiments and the modifications may be appropriately combined.

Second Embodiment

Hereinafter, a decompression absorption bottle according to the second embodiment of the present invention will be described with reference to the drawings.

Figure 5:
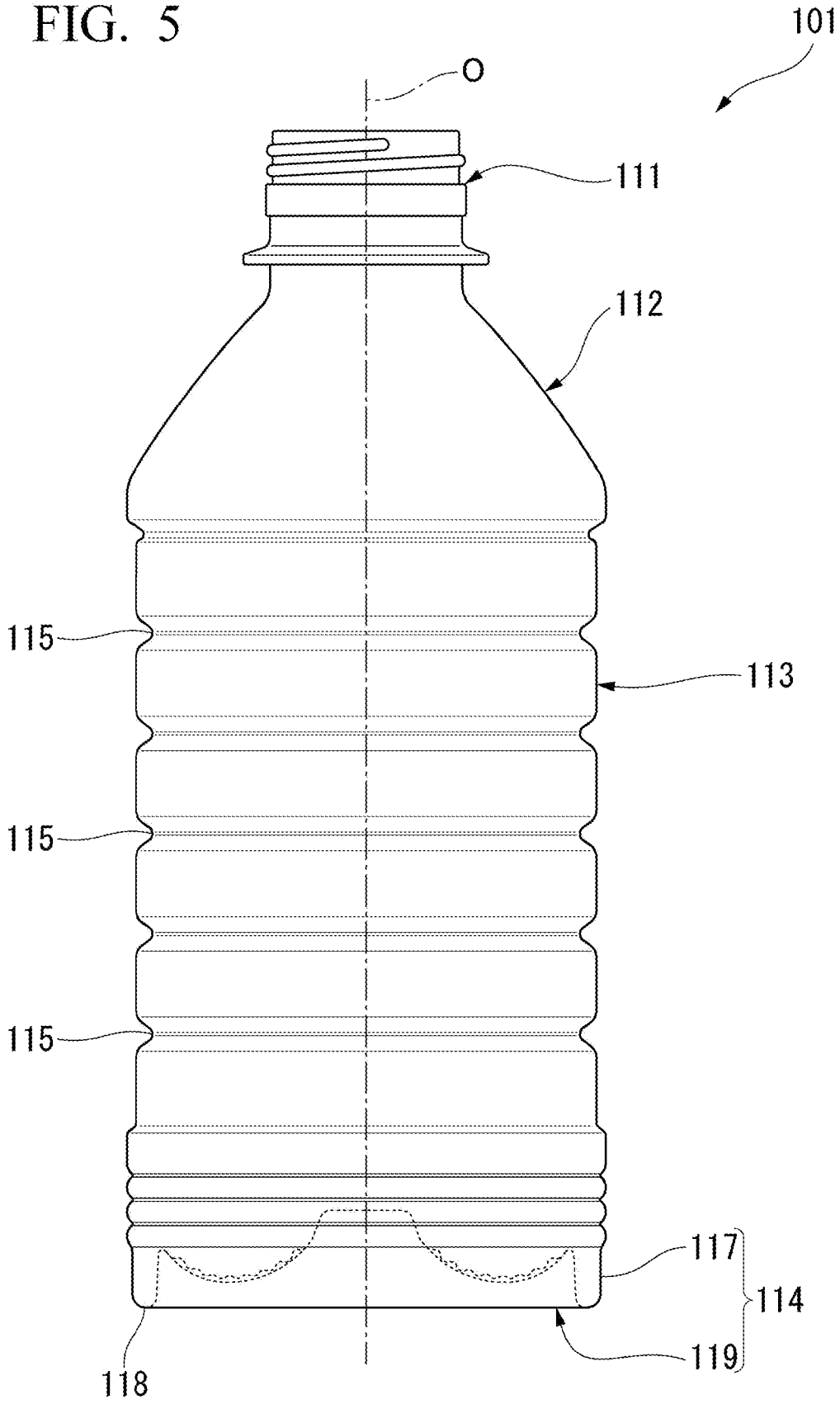
FIG. 5 is a side view of a decompression absorption bottle shown as a second embodiment of the present invention.

As shown in FIG. 5, a decompression absorption bottle 101 according to the present embodiment includes a mouth part 111, a shoulder part 112, a body part 113, and a bottom part 114, and has a schematic configuration in which the mouth part 111, the shoulder part 112, the body part 113, and the bottom part 114 are continuously provided in this order, with each central axis positioned on the common axis.

Hereinafter, the common axis is referred to as a bottle axis O, the mouth part 111 side along the bottle axis O is referred to as an upper side, the bottom part 114 side is referred to as a lower side, a direction along the bottle axis O is referred to as a vertical direction, a direction that intersects the bottle axis O is referred to as a radial direction of the bottle when viewed from the vertical direction, and the direction that orbits around the bottle axis O is referred to as a circumferential direction of the bottle.

The decompression absorption bottle 101 is formed by blow molding a preform formed into a cylinder with a bottom by injection molding, and is integrally formed of a synthetic resin material. A cap (not shown) is attached to the mouth part 111. In each of the mouth part 111, the shoulder part 112, the body part 113, and the bottom part 114, a shape when viewed in a cross section orthogonal to the bottle axis O has a circular shape.

A plurality of peripheral grooves 115 extending continuously over the entire circumference are formed in the body part 113 at intervals in the vertical direction.

The bottom part 114 is formed in a cup shape that includes a cylindrical heel part 117 in which an upper end opening portion is connected to a lower end opening portion of the body part 113, and a bottom wall part 119 that closed the lower end opening portion of the heel part 117 and has an outer peripheral edge as a ground contact part 118. That is, the bottom part 114 includes the heel part 117 and the bottom wall part 119, and the heel part 117 and the bottom wall part 119 form a cup shape.

Figure 6:
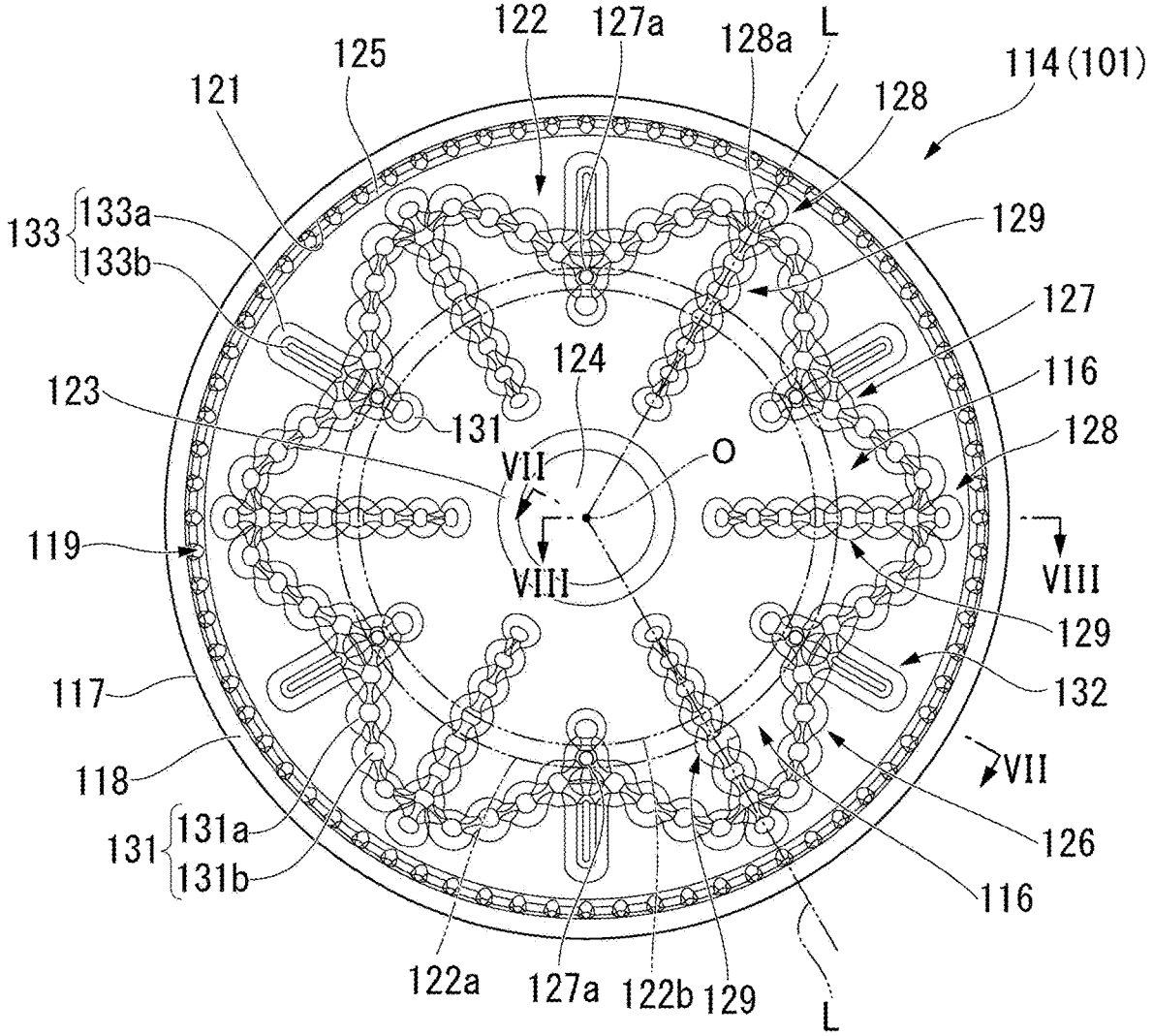
FIG. 6 is a bottom view of the decompression absorption bottle shown in FIG. 5.
Figure 7:
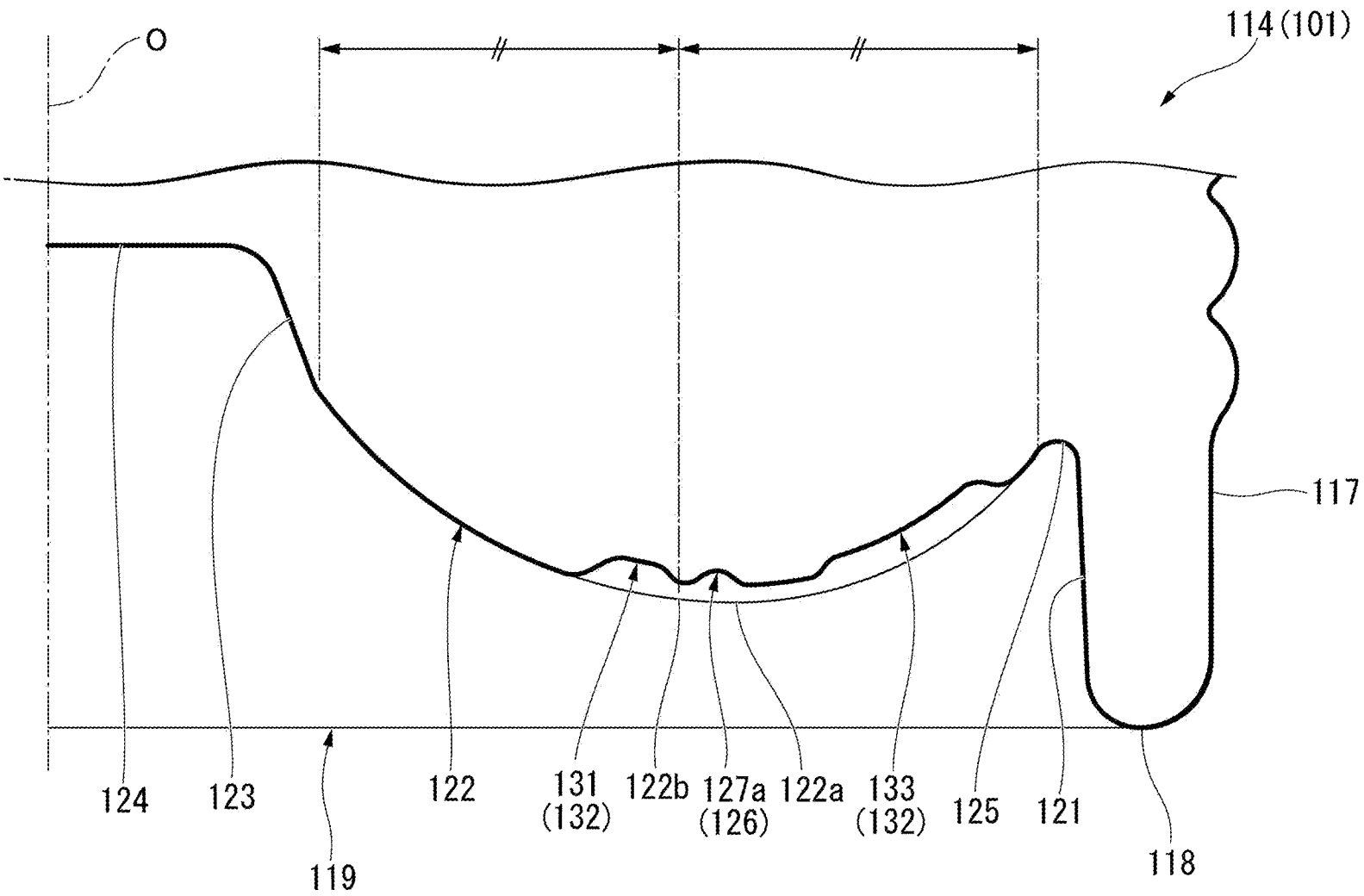
FIG. 7 is a cross-sectional view taken along a line VII-VII of FIG. 6.
Figure 8:
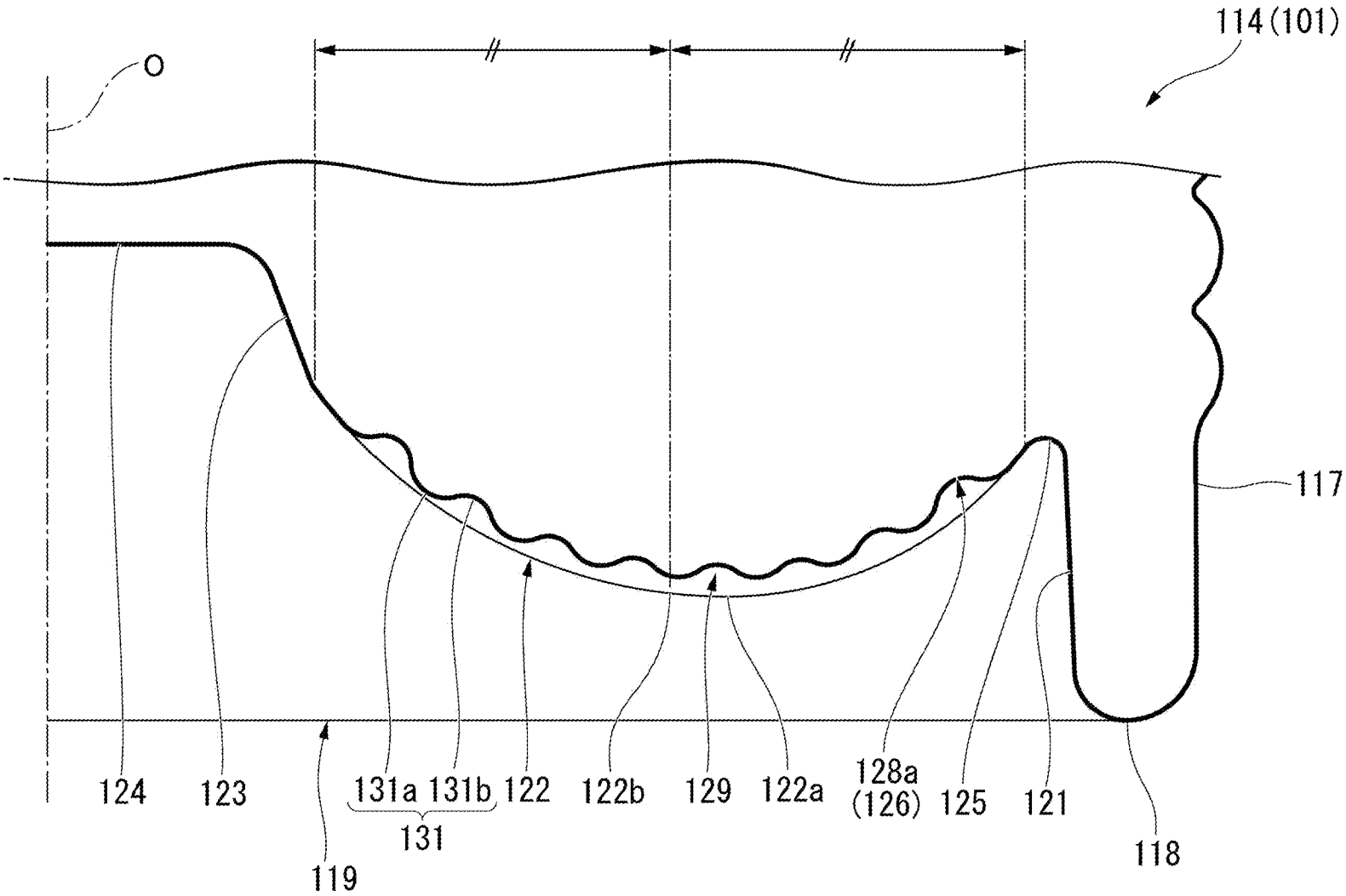
FIG. 8 is a cross-sectional view taken along a line VIII-VIII of FIG. 6.

As shown in FIGS. 6 to 8, the bottom wall part 119 includes an upright peripheral wall part 121 that is continued to the ground contact part 118 from the inside in the radial direction of the bottle and extends upward, an annular movable wall part 122 that extends inward in the radial direction of the bottle from the upper end portion of the upright peripheral wall part 121, and a central wall part 123 that is connected to an inner end portion of the movable wall part 122 in the radial direction of the bottle.

The upright peripheral wall part 121 extends almost straight along the vertical direction. The upright peripheral wall part 121 may extend in parallel with the battle axis O, or may be inclined by 5° or less, preferably 3° or less in the vertical direction to extend inward in the radial direction of the bottle from the lower side to the upper side in consideration of release properties to the mold. In the shown example, this inclined angle of the upright peripheral wall part 121 is, for example, about 2.5°.

The central wall part 123 extends upward from the inner end portion of the movable wall part 122 in the radial direction of the bottle. The central wall part 123 is disposed coaxially with the bottle axis O and is formed in a cylindrical shape whose diameter increases from the upper side to the lower side. A disk-shaped top wall 124 disposed coaxially with the bottle axis O is connected to the upper end portion of the central wall part 123, and the central wall part 123 and the top wall 124 as a whole form a topped cylindrical shape. The central wall part 123 has a circular shape in a cross-sectional view. The central wall part 123 may have a square shape or the like in a cross-sectional view.

The movable wall part 122 is formed in an annular shape and is disposed coaxially with the bottle axis O. An outer end portion of the movable wall part 122 in the radial direction of the bottle is connected to an upper end portion of the upright peripheral wall part 121, and an inner end portion in the radial direction of the bottle is connected to an outer end portion of the central wall part 123 in the radial direction of the bottle. The outer end portion of the movable wall part 122 in the radial direction of the bottle and the upper end portion of the upright peripheral wall part 121 are connected to each other via a curved surface part 125 that is recessed upward. The movable wall part 122 is freely rotatable around a curved surface portion connecting portion with the upright peripheral wall part 121) 125 to move the central wall part 123 in the vertical direction.

The movable wall part 122 is formed in a curved surface shape that protrudes downward. The lowermost part 122*a* located at the lowermost part of the movable wall part 122 is disposed in a portion of the movable wall part 122 located on the outer side in the radial direction of the bottle than the central position 122*b* in the radial direction of the bottle. The movable wall part 122 extends upward as it goes away from the lowermost part 122*a* in the radial direction of the bottle.

The lowermost part 122*a* may be disposed at the central position 122*b* in the radial direction of the bottle of the movable wall part 122, or may be disposed in a portion of the movable wall part 122 located on the inner side in the radial direction of the bottle than the central position 122*b* in the radial direction of the bottle.

The lowermost part 122*a* is located below the curved surface part 125. In the vertical cross-sectional view along the vertical direction, the radius of curvature of the portion of the movable wall part 122 in which the lowermost part 122*a* is located is larger than the radius of curvature of the curved surface part 125. In the vertical cross-sectional view the radius of curvature of the portion of the movable wall part 122 located inside the lowermost part 122*a* in the radial direction of the bottle is larger than the radius of curvature of the portion located on the outer side than the lowermost part 122*a* in the radial direction of the bottle.

The decompression absorption bottle 101 configured as described above is filled with the contents of a high temperature (for example, about 40° C. to 95° C.), and at this time, the movable wall part 122 is displaced and deformed downward. By sealing in this state, the movable wall part 122 turns upward around the curved surface part 125 while being deformed upward when decompressing the inside of the decompression absorption bottle 101 with the subsequent cooling, and the decompression is absorbed.

Further, in the present embodiment, the movable wall part 122 is provided with an annular recess 126 that is recessed upward and extends in the circumferential direction of the bottle. The annular recess 126 has a configuration in which an inner corner part 127 having a V-shape or a U-shape that is convex toward the inside in the radial direction of the bottle when viewed from below, and an outer corner part 128 having a V-shape or a U-shape protruding outward in the radial direction of the bottle are alternately continued to each other in the circumferential direction of the bottle.

When viewed from below, respective angles formed by the inner corner part 127 and the outer corner part 128 are the same as each other. When viewed from below, the respective angles formed by the inner corner part 127 and the outer corner part 128 may be different from each other. The number of each of the inner corner part 127 and the outer corner part 128 is the same, for example, 3 to 12 is preferable, and the number is 6 in the shown example.

An outer end portion (hereinafter referred to as a peak part) 128*a* in the radial direction of the bottle of the outer corner part 128 is provided at the outer end portion of the movable wall part 122 in the radial direction of the bottle.

An inner end portion (hereinafter referred to as a valley part) 127*a* in the radial direction of the bottle at the inner corner part 127 is provided art a portion of the movable wall part 122 located on the outer side in the radial direction of the bottle than the central position 122*b* in the radial direction of the bottle. The valley part 127*a* is provided in a portion of the movable wall part 122 located inside the lowermost part 122*a* in the radial direction of the bottle. The inner corner part 127 straddles the lowermost part 122*a* of the movable wall part 122 in the radial direction of the bottle.

The valley part 127*a* may be provided at the central position 122*b* in the radial direction of the bottle of the movable wall part 122, or may be provided at a portion of the movable wall part 122 located on the inner side in the radial direction of the bottle than the central position 122*b* in the radial direction of the bottle, or may be provided at the lowermost part 122*a* of the movable wall part 122, or may be provided at a portion of the movable wall part 122 located on the outer side than the lowermost part 122*a* in the radial direction of the bottle.

Second radial recesses 129 that are recessed upward and extend in the radial direction of the bottle are separately provided at portions of the movable wall part 122 located on both sides of the valley part 127*a* in the circumferential direction of the bottle. A plurality (for example, three to eight) of second radial recesses 129 are provided at equal intervals in the circumferential direction of the bottle. The second radial recess 129 corresponds to the radial recess 29 of the first embodiment.

A portion of the movable wall part 122 located inside the annular recess 126 in the radial direction of the bottle has a configuration in which a plurality of panel surface parts 116 surrounded by an inner corner part 127 and two second radial recesses 29 sandwiching the valley part 127*a* in the circumferential direction of the bottle are connected in the circumferential direction of the bottle via the second radial recess 129.

A plurality of valley parts 127*a* may be located between the second radial recesses 129 that are adjacent to each other in the circumferential direction of the bottle.

The widths of each of the second radial recess 129 and the annular recess 126 are the same as each other. The second radial recess 129 is located on a straight L passing through the peak part 128*a* and the bottle axis O when viewed from below.

The widths of each of the second radial recess 129 and the annular recess 126 may be different from each other. The second radial recess 129 may be located on a straight line passing through a portion located between the peak part 128*a* and the valley part 127*a* and the bottle axis O when viewed from below.

An outer end portion of the second radial recess 129 in the radial direction of the bottle is connected to the annular recess 126. An inner end portion of the second radial recess 129 in the radial direction of the bottle is located on the outer side in the radial direction of the bottle than the outer end portion of the central wall part 123 in the radial direction of the bottle.

The outer end portion of the second radial recess 129 in the radial direction of the bottle may be located inside the annular recess 126 in the radial direction of the bottle, and the inner end portion of the second radial recess 129 in the radial direction of the bottle may be connected to the outer end portion of the central wall part 123 in the radial direction of the bottle.

The annular recess 126 and the second radial recess 129 are each configured by connection of a plurality of dimples 131 formed in a curved surface shape that is recessed upward. The annular recess 126 is configured by connection of the plurality of dimples 131 connected in the circumferential direction of the bottle, and the second radial recess 129 is configured by connection of the plurality of dimples 131 connected in the radial direction of the bottle. The dimples 131 of each of the annular recess 126 and the second radial recess 129 are formed to have the same shape and the same size as each other. The dimples 131 of each of the annular recess 126 and the second radial recess 129 may be formed to have different shapes and different sizes from each other.

In the shown example, each dimple 131 includes a connecting recess 131*a* and a main body recess 131*b* formed on a bottom surface of the connecting recess 131*a*. An inner diameter of the main body recess 131*b* is smaller than an inner diameter of the connecting recess 131*a*. In each of the annular recess 126 and the second radial recess 129, the main body recesses 131*b* adjacent to each other are provided at intervals, and the connecting recesses 131*a* adjacent to each other are provided in a row.

Each dimple 131 may include only one of the main body recess 131*b* and the connecting recess 131*a*, and the dimples 131 adjacent to each other may be provided at intervals. The annular recess 126 and the second radial recess 129 may be formed by a groove extending linearly and continuously or a groove extending linearly and intermittently instead of the plurality of dimples 131.

The movable wall part 122 is provided with a first radial recess 132 that is recessed upward and extends from the valley part 127*a* in the radial direction of the bottle. The first radial recess 132 straddles the valley part 127*a* in the radial direction of the bottle when viewed from below.

The first radial recess 132 may extend from the valley part 127*a* only to the outside in the radial direction of the bottle, or may extend from the valley part 127*a* only to the inside in the radial direction of the bottle.

The widths of each of the first radial recess 132 and the second radial recess 129 are the same as each other. The widths of each of the first radial recess 132 and the second radial recess 129 may be different from each other.

The first radial recess 132 is provided at the central part of the bottle in the circumferential direction between the second radial recesses 129 that are adjacent to each other in the circumferential direction.

Positions in the radial direction of the bottle of each of the outer end portion of the first radial recess 132 in the radial direction of the bottle and the peak part 128*a* are the same as each other. The positions in the radial direction of the bottle of each of the outer end portion of the first radial recess 132 in the radial direction of the bottle and the peak part 128*a* may be different from each other.

The inner end portion of the first radial recess 132 in the radial direction of the bottle is located on the outer side in the radial direction of the bottle than the inner end portion of the second radial recess 129 in the radial direction of the bottle. The inner end portion of the first radial recess 132 in the radial direction of the bottle may be located at the same position in the radial direction of the bottle with respect to the inner end portion of the second radial recess 129 in the radial direction of the bottle, and ma be located inside in the radial direction of the bottle. The inner end portion of the first radial recess 132 in the radial direction of the bottle straddles the central position 122*b* in the radial direction of the bottle of the movable wall part 122 in the radial direction of the bottle.

A length of the first radial recess 132 in the radial direction of the bottle is shorter than a length of the second radial recess 129 in the radial direction of the bottle.

The length of the first radial recess 132 in the radial direction of the bottle may be greater than or equal to the length of the second radial recess 129 in the radial direction of the bottle.

A length in the radial direction of the bottle of a portion of the first radial recess 132 located inside the valley part 127*a* in the radial direction of the bottle is shorter than a length in the radial direction of the bottle of a portion located outside the valley part 127*a* in the radial direction of the bottle.

The length in the radial direction of the bottle of the portion of the first radial recess 132 located inside the valley part 127*a* in the radial direction of the bottle may be equal to or longer than the length in the radial direction of the bottle of the portion located outside the valley part 127*a* in the radial direction of the bottle.

A portion of the first radial recess 132 that extends inward from the valley part 127*a* in the radial direction of the bottle is formed by the dimple 131 formed in a curved surface shape recessed upward, similarly to the annular recess 126 and the second radial recess 129.

A portion of the first radial recess 132 that extends outward from the valley part 127*a* in the radial direction of the bottle is formed by the groove 133 extending linearly and continuously. The portion of the first radial recess 132 that extends outward from the valley part 127*a* in the radial direction of the bottle may be formed by a plurality of dimples, or may be formed by a groove that extends linearly and intermittently.

The portion (the dimple 131) of the first radial recess 132 that extends inward from the valley part 127*a* in the radial direction of the bottle, and the portion (the groove 133) that extends outward from the valley part 127*a* in the radial direction of the bottle may be formed by continuous or intermittent groove extending integrally.

The first radial recess 132 is not limited to being provided consecutively in the valley part 127*a*, but may be provided at intervals.

The groove 133 includes a connecting groove part 133*a* and a main body groove part 133*b* formed on the bottom surface of the connecting groove part 133*a*. In each of the annular recess 126 and the first radial recess 132, the main body recess 131*b* and the main body groove part 133*b* adjacent to each other are provided at intervals, and the connecting recess 131*a* and the connecting groove part 133*a* adjacent to each other are provided in a row.

The groove 133 may include only one of the connecting groove part 133*a* and the main body groove part 133*b*.

As described above, according to the decompression absorption bottle 101 according to the present embodiment, the movable wall part 122 is provided with an annular recess 126 that is recessed upward and extends in the circumferential direction of the bottle, and the annular recess 126 is configured by alternate joining of the inner corner part 127 and the outer corner part 128 in the circumferential direction of the bottle. As a result, when decompressing the inside of the decompression absorption bottle 1 (hereinafter referred to as a decompression time), since the movable wall part 122 not only turns upward around the curved surface part 125, but also each portion of the movable wall part 122 in which the plurality of valley parts 127*a* are located serves as a starting point, it is possible to easily deform the movable wall part 122 upward.

The movable wall part 122 is provided with a first radial recess 132 that is recessed upward and extends from the valley part 127*a* in the radial direction of the bottle. As a result, at the time of decompression, not only the valley part 127*a* but also the portion of the movable wall part 122 that is continued to the valley part 127*a* in the radial direction of the bottle can be easily deformed upward.

Accordingly, it is possible to preferentially deform the bottom part 114 at the time of depressurization to suppress the deformation of the body part 113.

The first radial recess 132 straddles the valley part 127*a* in the radial direction of the bottle when viewed from below. As a result, at the time of decompression, the portion of the movable wall part 122 that is continued to the valley part 127*a* in the radial direction of the bottle can be easily deformed upward over a wide range.

The movable wall part 122 is formed in a curved surface shape that protrudes downward. As a result, it is possible to secure the pressure-receiving area of the movable wall part 122, and to greatly secure a deformation allowance toward the upper side of the movable wall part 22 at the time of decompression.

The inner corner part 127 having a valley part 127*a*, which serves a starting point of deformation at the time of decompression, straddles the lowermost part 122*a* of the movable wall part 122, which is located at the lowest position and is unlikely to be deformed upward at the time of decompression in the radial direction of the bottle. As a result, at the time of decompression, the movable wall part 122 can be easily deformed upward smoothly, and the deformation of the body part 113 can be reliably suppressed.

Since the valley part 127*a* is provided at a portion of the movable wall part 122 located on the outer side in the radial direction of the bottle than the central position 122*b* in the radial direction of the bottle, it is possible to widely secure the portion of the movable wall part 122 surrounded by the annular recess 126, and to reliably and easily deform the movable wall part 122 upward smoothly at the time of decompression.

Second radial recesses 129 that are recessed upward and extend in the radial direction of the bottle are separately provided at portions of the movable wall part 122 located on both sides that sandwich the valley part 127*a* in the circumferential direction of the bottle. As a result, at the time of decompression, in the movable wall part 122, the plurality of panel surface parts 116 surrounded by the inner corner part 127 and the two second radial recesses 129 that sandwich the valley part 127*a* in the circumferential direction of the bottle are individually deformed upward, starting from the portion in which the valley part 127*a* is located. As a result, at the time of decompression, the movable wall part 122 can be easily deformed upward smoothly.

Since the valley part 127*a* is provided at a portion of the movable wall part 122 located on the outer side in the radial direction of the bottle than the central position 122*b* in the radial direction of the bottle, it is possible to widely secure the above-mentioned panel surface part 116, and to reliably and easily deform the movable wall part 122 upward smoothly at the time of decompression.

The second radial recess 129 is located on a straight line L passing through the peak part 128*a* and the bottle axis O when viewed from below. As a result, it is possible to widely secure the above-mentioned panel surface part 116, and to reliably and easily deform the movable wall part 122 upward smoothly at the time of decompression.

The technical scope of the present invention is not limited to the above-described embodiment, and various modifications can be made without departing from the spirit of the present invention.

For example, the central wall part 123 is not limited to that of the above embodiment. The central wall part 123 may be appropriately modified such that it extends straight along the vertical direction or is formed in a flat plate shape.

As the bottom wall part 119, a configuration having no top wall 124 and having, for example, a central wall part 123 formed in a conical shape may be adopted.

As the annular recess 126, a configuration having one inner corner part 127 may be adopted.

A configuration having no second radial recess 129 may be adopted.

The synthetic resin material that forms the decompression absorption bottle 101 may be appropriately changed to, for example, polyethylene terephthalate, polyethylene naphthalate, amorphous polyester, a blend material thereof or the like.

The decompression absorption bottle 101 is not limited to a single-layer structure, but may be a laminated structure having an intermediate layer. Examples of the intermediate layer may include a layer made of a resin material having a gas barrier property, a layer made of a recycled material, a layer made of a resin material having an oxygen absorption property, and the like.

In the above embodiment, although the shape when viewed in a cross section orthogonal to the bottle axis O of each of the mouth part 111, the shoulder part 112, the body part 113, and the bottom part 114 is a circular shape, the present invention is not limited thereto. The shape when viewed in a cross section may be appropriately changed, for example, to have a square shape.

In addition, it is possible to replace the components in the embodiment with well-known components as appropriate without departing from the spirit of the present invention, and the embodiments and the modifications may be appropriately combined.

INDUSTRIAL APPLICABILITY

According to the present invention, when decompressing the inside of the decompression absorption bottle, the bottom part can be preferentially deformed to suppress the deformation of the body part.

REFERENCE SIGNS LIST

1, 101 Decompression absorption bottle
14, 114 Bottom part
18, 118 Ground contact part
19, 119 Bottom wall part
21, 121 Upright peripheral wall part
22, 122 Movable wall part
22*a*, 122*a* Lowermost part
22*b*, 122*b* Central position
25, 125 Curved surface part (connecting portion)
26, 126 Annular recess
27, 127 Inner corner part
27*a*, 127*a* Valley part (inner end portion)
28, 128 Outer corner part
28*a*, 128*a* Peak part (Outer end portion)
29, 129 Radial recess (Second radial recess)
132 First radiant recess
L Straight line
O Bottle axis

The invention claimed is:

1. A decompression absorption bottle which is formed of a synthetic resin material and has a cylindrical shape, the bottle comprising:

a bottom part, wherein a bottom wall part of the bottom part includes:

a ground contact part located on an outer peripheral edge portion;

an upright peripheral wall part which is continued to the ground contact part from an inside in a radial direction of the bottle and extends upward; and an annular movable wall part which extends inward in the radial direction of the bottle from an upper end portion of the upright peripheral wall part, wherein the movable wall part is disposed to be freely rotatable in a vertical direction around a connecting portion with the upright peripheral wall part, the movable wall part is provided with an annular recess which is recessed upward and extends in a circumferential direction of the bottle, and the annular recess is configured that an inner corner part having a V-shape or a U-shape protruding inward in the radial direction of the bottle when viewed from below, and an outer corner part having a V-shape or U-shape protruding outward in the radial direction of the bottle are alternately continued to each other in the circumferential direction of the bottle.

2. The decompression absorption bottle according to claim 1, wherein the movable wall part is formed in a curved surface shape which protrudes downward, and an inner end portion of the inner corner part in the radial direction of the bottle is provided at a lowermost part located at a lowermost position of the movable wall part.

3. The decompression absorption bottle according to claim 1, wherein radial recesses which are recessed upward and extend in the radial direction of the bottle are separately provided at portions in the movable wall part, the portions which are located on both sides that sandwich an inner end portion in the radial direction of the bottle at the inner corner part in the circumferential direction of the bottle.

4. The decompression absorption bottle according to claim 3, wherein the radial recesses are located on a straight line which passes through an outer end portion in the radial direction of the bottle at the outer corner part and a bottle axis when viewed from below.

5. The decompression absorption bottle according to claim 1, wherein the inner end portion in the radial direction of the bottle at the inner corner part is provided at a portion of the movable wall part, the portion which is located on an outer side in the radial direction of the bottle than a central position in the radial direction of the bottle.

6. The decompression absorption bottle according to claim 1, wherein the movable wall part is provided with a first radial recess which is recessed upward and extends from the inner end portion in the radial direction of the bottle at the inner corner part in the radial direction of the bottle.

7. The decompression absorption bottle according to claim 6, wherein the first radial recess straddles the inner end portion in the radial direction of the bottle at the inner corner part in the radial direction of the bottle when viewed from below.

8. The decompression absorption bottle according to claim 6, wherein the movable wall part is formed in a curved surface shape that protrudes downward, and the inner corner part straddles the lowermost part located at the lowermost position of the movable wall part in the radial direction of the bottle.

9. The decompression absorption bottle according to claim 6, wherein the inner end portion in the radial direction of the bottle at the inner corner part is provided at a portion of the movable wall part, the portion is located on the outer side in the radial direction of the bottle than the central position in the radial direction of the bottle.

10. The decompression absorption bottle according to claim 6, wherein second radial recesses which are recessed upward and extend in the radial direction of the bottle are separately provided at portions in the movable wall part, the portions which are located on both sides that sandwich an inner end portion in the radial direction of the bottle at the inner corner part in the circumferential direction of the bottle.

11. The decompression absorption bottle according to claim 10, wherein the second radial recesses are located on a straight line which passes through an outer end portion in the radial direction of the bottle at the outer corner part and a bottle axis when viewed from below.

* * * * *